US010004304B2

(12) United States Patent
Nagahara et al.

(10) Patent No.: US 10,004,304 B2
(45) Date of Patent: Jun. 26, 2018

(54) BAND AND TIMEPIECE

(71) Applicant: CASIO COMPUTER CO., LTD., Shibuya-ku, Tokyo (JP)

(72) Inventors: Miho Nagahara, Ome (JP); Junichi Sato, Hino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days. days.

(21) Appl. No.: 15/278,548

(22) Filed: Sep. 28, 2016

(65) Prior Publication Data

US 2017/0164698 A1 Jun. 15, 2017

(30) Foreign Application Priority Data

Dec. 10, 2015 (JP) ..... 2015-241252

(51) Int. Cl.
*A44C 5/14* (2006.01)
*G04B 37/14* (2006.01)

(52) U.S. Cl.
CPC ..... *A44C 5/14* (2013.01); *G04B 37/1486* (2013.01)

(58) Field of Classification Search
CPC ... A44C 5/14; G04B 37/1486; G04B 37/1493
USPC ..... 368/282, 280–281; 224/164–180
See application file for complete search history.

(56) References Cited

U.S. PATENT DOCUMENTS 6,712,501 B2 * 3/2004 Kinkio ..... A44C 5/14 224/169
6,960,016 B2 * 11/2005 Apotheloz ..... G04G 17/083 224/165
8,613,544 B2 * 12/2013 Kitahara ..... B29C 70/70 368/282

FOREIGN PATENT DOCUMENTS

JP 43027753 Y1 11/1968
JP 2006109952 A 4/2006

OTHER PUBLICATIONS

Japanese Office Action dated Sep. 27, 2017 issued in counterpart Japanese Application No. 2015-241252.

* cited by examiner

*Primary Examiner* — Edwin A. Leon
(74) *Attorney, Agent, or Firm* — Holtz, Holtz & Volek PC

(57) ABSTRACT

The present invention is a band including a band main body and a band coupling member which is attached to an end portion of the band main body and a band attachment section of an attachment target member corresponding to the end portion of the band main body, in which the band coupling member has a structure where a plurality of component pieces are arranged in a direction orthogonal to a longitudinal direction of the band main body and fixed to one another.

19 Claims, 9 Drawing Sheets

BAND AND TIMEPIECE

CROSS-REFERENCE TO RELATED APPLICATION

This application is based upon and claims the benefit of priority from the prior Japanese Patent Application No. 2015-241252, filed Dec. 10, 2015, the entire contents of which are incorporated herein by reference.

BACKGROUND OF THE INVENTION

1. Field of the Invention

The present invention relates to a band for use in an arm-wearable device such as a wristwatch, a bag, a purse, and the like, and a timepiece including the band.

2. Description of the Related Art

For example, the structure of a watch band is known in which a band coupling member is attached to an end portion of a band main body and then attached to a wristwatch case, so that the band main body is attached to the wristwatch case, as described in Japanese Patent Application Laid-Open (Kokai) Publication No. 2006-109952.

The band coupling member of this watch band includes a case attachment piece that is attached to the wristwatch case and a band coupling piece that is attached to the end portion of the band main body, and is structured such that the band coupling piece is attached to the case attachment piece with a screw member, and whereby the band main body is attached to the wristwatch case with the case attachment piece being covered with the band coupling piece.

However, in this watch band where the band coupling member for attaching the band main body to the wristwatch case is structured such that the band coupling member to be attached to the end portion of the band main body is attached with the screw member to the case attachment piece to be attached to the wristwatch case, the number of components is large, and therefore attachment work therefor is complicated and burdensome. In addition, since the band coupling piece which covers the case attachment piece and therefore is viewable from outside has a simple structure, the ornamental quality is low.

SUMMARY OF THE INVENTION

The present invention is a band with a minimum number of components and excellent ornamental quality by which attachment work can be simplified, and a timepiece having the band.

In accordance with one aspect of the present invention, there is provided a band comprising: a band main body; and a band coupling member which is attached to an end portion of the band main body and a band attachment section of an attachment target member corresponding to the end portion of the band main body, wherein the band coupling member has a structure where a plurality of component pieces are arranged in a direction orthogonal to a longitudinal direction of the band main body and fixed to one another.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

Hereafter, an embodiment in which the present invention has been applied in a wristwatch is described with reference to FIG. 1 to FIG. 9.

Figure 1:
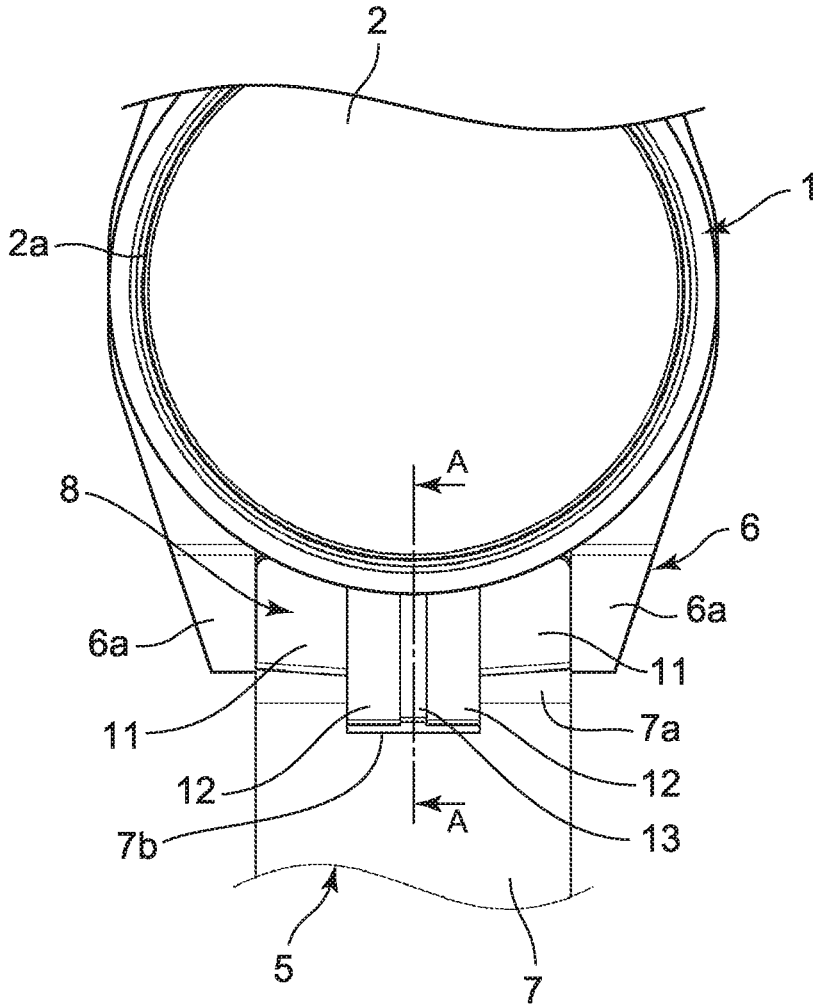
FIG. 1 is an enlarged, partially-omitted front view of an embodiment in which the present invention has been applied in a wristwatch.
Figure 2:
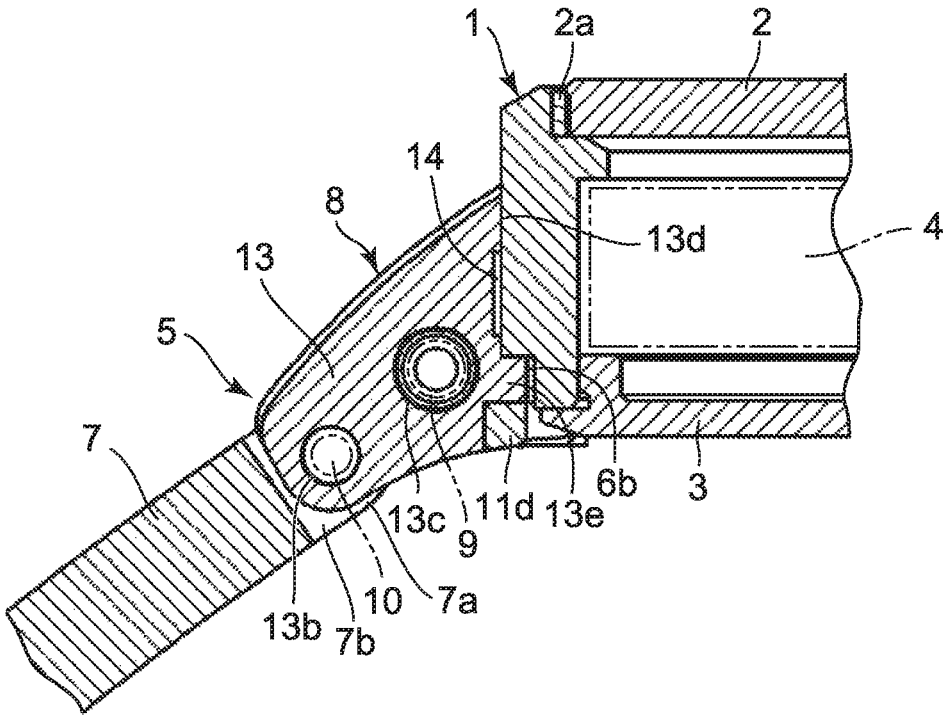
FIG. 2 is an enlarged sectional view of the main portion of the wristwatch taken along line A-A in FIG. 1.

This wristwatch includes a wristwatch case 1, as shown in FIG. 1 and FIG. 2. The wristwatch case 1 is formed into a substantially cylindrical shape. On the upper opening of the wristwatch case 1, a timepiece glass 2 is attached via a gasket 2*a*. On a lower portion of the wristwatch case 1, a rear lid 3 is attached.

Inside the wristwatch case 1, a timepiece module 4 is provided, as shown in FIG. 2. The timepiece module 4 includes various components (not shown) necessary for a timepiece function, such as a timepiece movement for driving hands, a display panel for electro-optically displaying information regarding time, date, and the like, and a circuit section for electrically driving the timepiece movement and the display panel.

Also, on the twelve o'clock side (not shown) and six o'clock side of the wristwatch case 1, band attachment sections 6 are provided so as to attach a band 5, as shown in FIG. 1 and FIG. 2. These band attachment sections 6 each include a pair of attachment projecting sections 6*a* projecting outward from a side surface of the wristwatch case 1. The band 5 includes a band main body 7 and a band coupling member 8.

That is, the band 5 is structured such that the band main body 7 is attached to the band attachment section 6 of the wristwatch case 1 via the band coupling member 8, as shown in FIG. 1 and FIG. 2. In this embodiment, the band main body 7 may be made of elastic synthetic resin such as urethane resin, metal with sequentially-coupled band pieces made of metal, or leather such as synthetic leather or natural leather.

The band coupling member 8 is structured such that it is arranged between the pair of attachment projecting sections 6*a* in the band attachment section 6 of the wristwatch case 1 and attached in this state to the band attachment section 6 by a first pin member 9 (refer to FIG. 8), and an end portion 7*a* of the band main body 7 is attached by a second pin member 10 (refer to FIG. 8), as shown in FIG. 1 and FIG. 2.

That is, the band coupling member 8 is formed such that its length in the direction orthogonal to the longitudinal direction of the band main body 7 is substantially equal to a length between the pair of attachment projecting sections 6*a* in the band attachment section 6 of the wristwatch case 1, as shown in FIG. 1. Also, the band coupling member 8 is formed such that its length in the longitudinal direction of the band main body 7 is substantially equal to the projection length of the pair of attachment projecting sections 6*a* in the band attachment section 6 of the wristwatch case 1, except for some portion.

As a result, the band coupling member 8 is structured to be arranged between the pair of attachment projecting sections 6*a* in the band attachment section 6 of the wristwatch case 1, as shown in FIG. 1. In this embodiment, the band coupling member 8 is constituted by a plurality of component pieces 11 to 13 being arranged in the direction orthogonal to the longitudinal direction of the band main body 7 and fixed to one another.

More specifically, the plurality of component pieces 11 to 13 include a main body piece 11, first ornament pieces 12, and a second ornament piece 13, as shown in FIG. 3 to FIG. 8. The main body piece 11 is made of metal such as titanium (Ti) or stainless steel (SUS), and is formed such that its length in the direction orthogonal to the longitudinal direction of the band main body 7 is substantially equal to the length between the pair of attachment projecting sections 6*a* in the band attachment section 6 of the wristwatch case 1, as shown in FIG. 1 and FIG. 3 to FIG. 8.

Also, the main body piece 11 is formed such that its length in the longitudinal direction of the band main body 7 is substantially equal to the projection length of the pair of attachment projecting sections 6*a* in the band attachment section 6 of the wristwatch case 1, as shown in FIG. 1 and FIG. 3 to FIG. 8. Moreover, the main body piece 11 is formed such that its case-side end face 11*a* on the wristwatch case 1 side has a shape corresponding to an outer side surface of the wristwatch case 1 positioned between the pair of attachment projecting sections 6*a* of the band attachment section 6.

Figure 3:
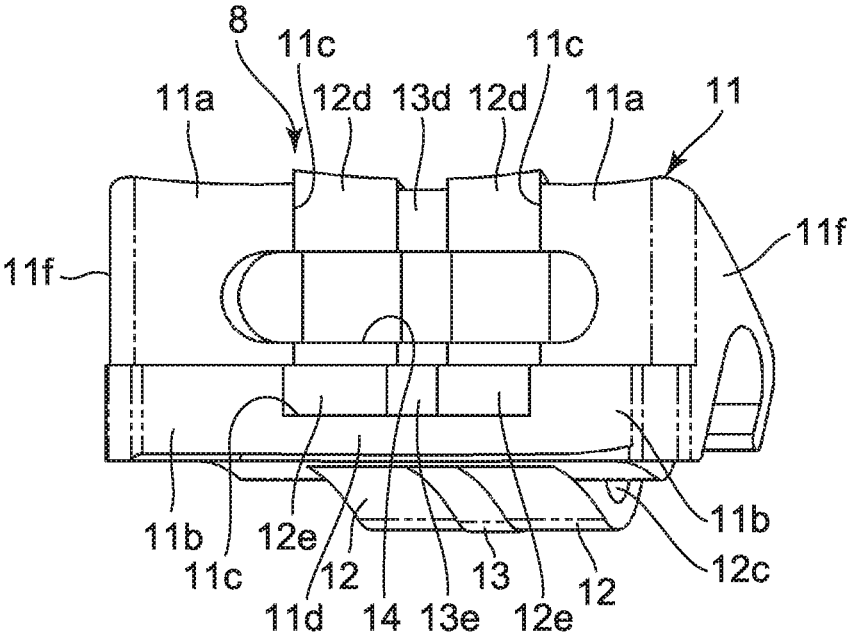
FIG. 3 is an enlarged perspective view of a band coupling section in a band of the wristwatch shown in FIG. 1.
Figure 4:
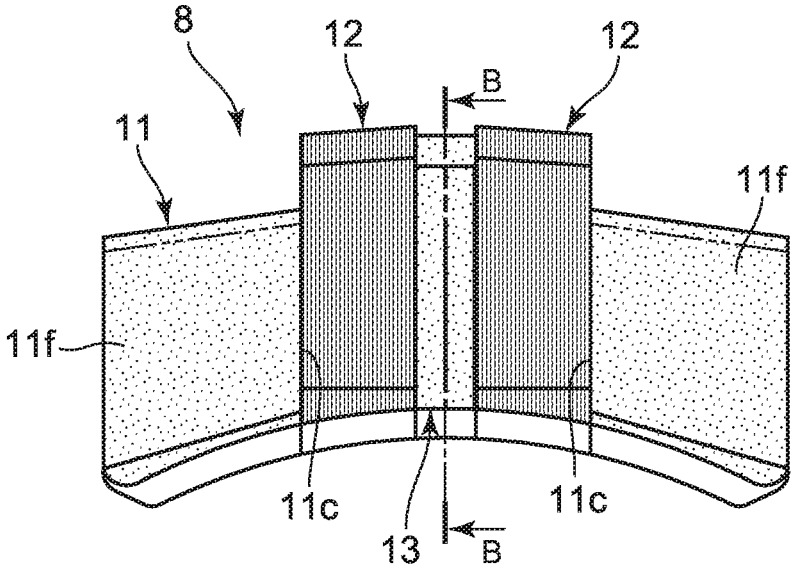
FIG. 4 is an enlarged planar view of the band coupling section shown in FIG. 3.

That is the main body piece 11 is formed such that its case-side end face 11*a* has a recessed curved surface, which is the same shape as that of a protruding curved surface of the outer side surface of the wristwatch case 1, as shown in FIG. 1, FIG. 3, and FIG. 4. In this embodiment, on a lower portion of the case-side end face 11*a* of the main body piece 11, an engaging projecting section 11*b*, which engages with an engaging recessed portion 6*b* provided on a lower portion of a side surface of the wristwatch case 1, is provided protruding toward the wristwatch case 1, as shown in FIG. 2, FIG. 3, FIG. 6A, and FIG. 6B.

As a result, the main body piece 11 is structured such that the engaging projecting section 11*b* of the case-side end face 11*a* engages with the engaging recessed portion 6*b* provided on the lower portion of the side surface of the wristwatch case 1 so as to bring the case-side end face 11*a* into close contact with the outer side surface of the wristwatch case 1 and, in this state, the main body piece 11 is arranged between the pair of attachment projecting sections 6*a* in the band attachment section 6 of the wristwatch case 1, as shown in FIG. 1 to FIG. 4.

In this embodiment, the main body piece 11 is structured such that an attachment section 11*c* is provided at a substantially intermediate portion in the direction orthogonal to the longitudinal direction of the band main body 7 and the first ornament pieces 12 and the second ornament piece 13 are arranged and mounted on the attachment section 11*c*, shown in FIG. 1 and FIG. 3 to FIG. 8. That is, the main body piece 11 is provided with a coupling section 11*d* on a lower portion of the case-side end face 11*a* corresponding to the outer side surface of the wristwatch case 1 positioned between the pair of attachment projecting sections 6*a* of the band attachment section 6.

As a result, the attachment section 11*c* of the main body piece 11 is structured such that, except for the coupling section 11*d* of the main body piece 11*d*, an upper side of the main body piece 11 and a band-side end portion 11*e* side where the band main body 7 is positioned is open by the periphery of the coupling section 11*d* being notched, as shown in FIG. 3 to FIG. 8. Accordingly, the main body piece 11 is structured such that both side portions 11*f* on both sides of the attachment section 11*c* are coupled by the coupling section 11*d*.

Figure 6A:
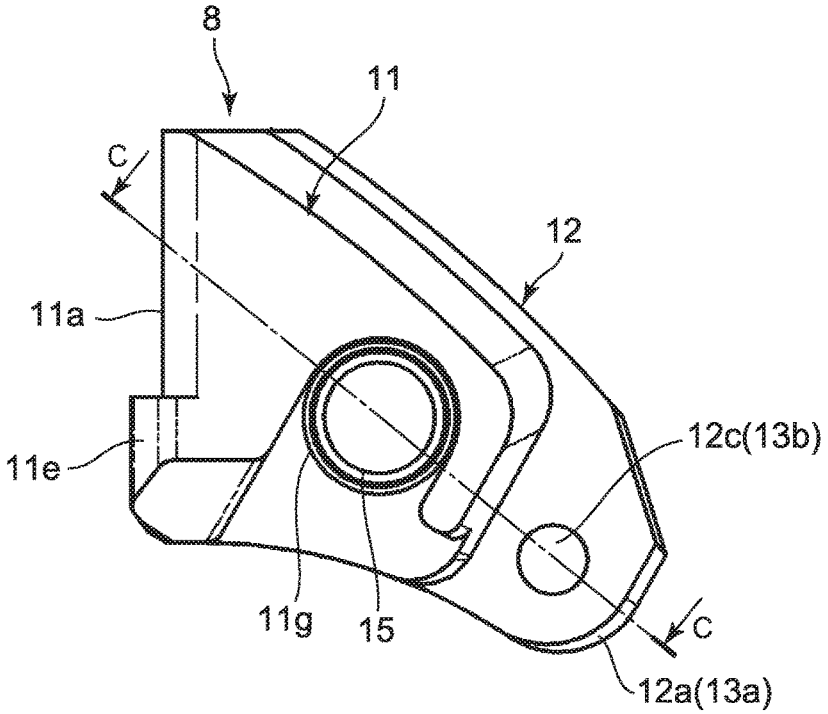
FIG. 6A is an enlarged side view of the band coupling section shown in FIG. 3 when viewed from right.
Figure 8:
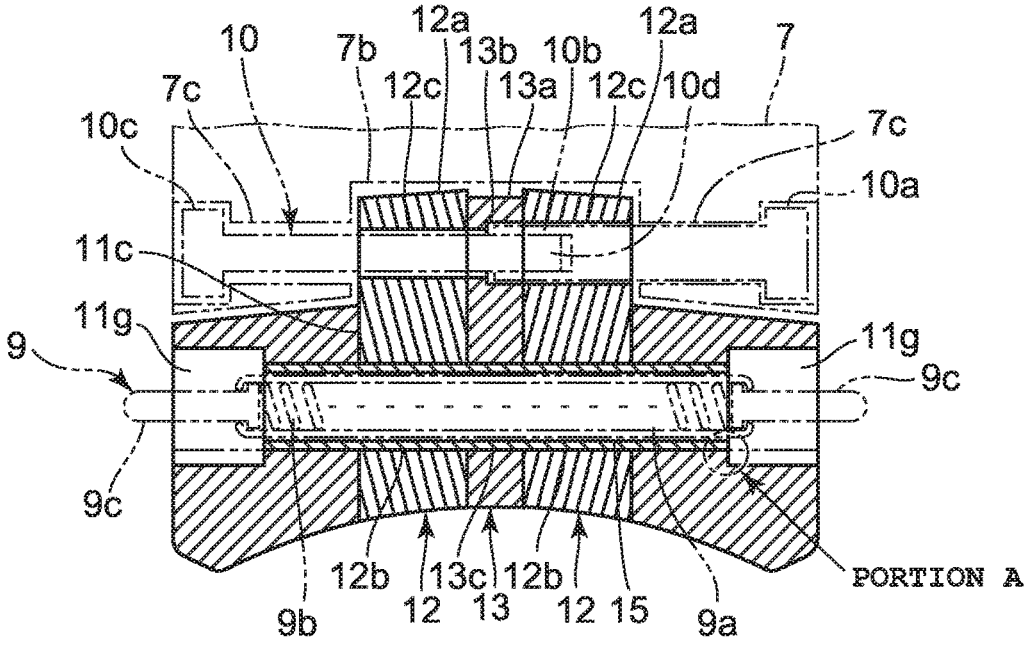
FIG. 8 is an enlarged sectional view of the band coupling member taken along line C-C in FIG. 6A.

In this embodiment, in the main body piece 11, the shape of each side surface of both side portions 11*f* on both sides of the attachment section 11*c* is formed to be substantially identical to the shape of each side surface of the paired attachment projecting section 6*a* of the band attachment section 6, as shown in FIG. 2 and FIG. 6A. Also, on both side portions 11*f* of the main body piece 11, case attachment holes 11*g* into which the first pin member 9 is inserted are respectively provided corresponding to each other on the same axis, as shown in FIG. 8.

Figure 5:
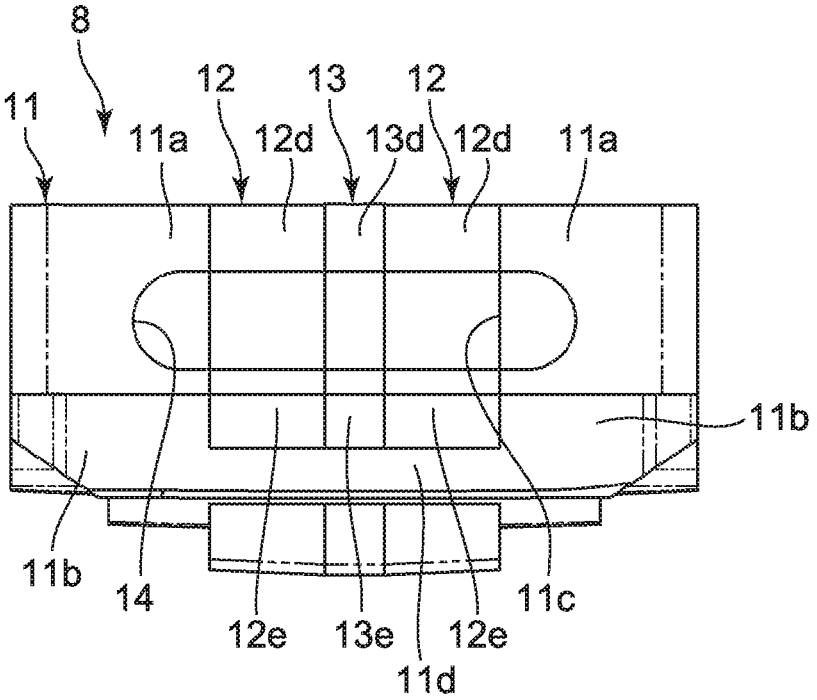
FIG. 5 is an enlarged side view of the band coupling section shown in FIG. 3 when viewed from a wristwatch case side.

As a result, the main body piece 11 is structured such that it is arranged between the paired attachment projecting section 6*a* in the band attachment section 6 of the wristwatch case 1 with the side surfaces of both side portions 11*f* on both sides of the attachment section 11*c* corresponding to the side surfaces of the pair of attachment projecting sections 6*a* of the band attachment section 6, and the case attachment holes 11*g* of both side portions 11*f* correspond to attachment holes (not shown) provided corresponding to the pair of attachment projecting sections 6*a*, as shown in FIG. 1 and FIG. 5.

On the other hand, as with the main body piece 11, the first ornament pieces 12 are made of metal such as titanium (Ti) or stainless steel (SUS), and are structured to be arranged on both sides in the attachment section 11*c* of the main body piece 11, as shown in FIG. 3 to FIG. 8. That is, each of these first ornament pieces 12 is formed having the same shape.

In this embodiment, in each of the first ornament pieces 12, a band-side end portion 12*a* positioned on the band main body 7 side is formed longer than the band-side end portion 11*e* of the main body piece 11, as shown in FIG. 2, FIG. 4, and FIG. 6A. Other than this, the first ornament pieces 12 are each formed into a substantially same shape as that of the main body piece 11. In this first ornament piece 12, a case attachment hole 12*b* into which the first pin member 9 is inserted is provided corresponding to the case attachment holes 11*g* of the main body piece 11, as shown in FIG. 8.

Also, each first ornament piece 12 is structured such that a band-side end portion 12*a* positioned on the band main body 7 side projects diagonally downward from the band-side end portion 11*e* of the main body piece 11, with the lower end portion of the first ornament piece 12 corresponding to the lower end portion of the main body piece 11, as shown in FIG. 2, FIG. 4, and FIG. 6A. Also, this first ornament piece 12 is structured such that a band attachment hole 12*c* into which the second pin member 10 is inserted is provided in the projecting band-side end portion 12*a*, as shown in FIG. 8.

As a result, the first ornament piece 12 is structured such that the band-side end portion 12*a* projects from a tip end portion of the pair of attachment projecting sections 6*a* in the band attachment section 6 of the wristwatch case 1 toward the band main body side 7 and the end portion 7*a* of the band main body 7 is attached to the projecting band-side end portion 12*a* with the second pin member 10 of FIG. 8, as shown in FIG. 1, FIG. 2, FIG. 4, and FIG. 6A.

Also, the upper end of the first ornament piece 12 is formed slightly projecting upward from an upper end portion of the main body piece 11, as shown in FIG. 2, FIG. 4, and FIG. 6A. In this first ornament piece 12, as shown in FIG. 4, the case-side end face 12*d* on the wristwatch case 1 side is formed into a shape corresponding to the outer side surface of the wristwatch case 1, as with the case-side end face 11*a* of the main body piece 11. That is, the case-side end face 12*d* of the first ornament piece 12 is formed having a recessed curved surface, which has the same shape as that of the protruding curved surface of the outer side surface of the wristwatch case 1.

In this case as well, on a lower portion of the case-side end face 12*d* of the first ornament piece 12, an engaging projecting section 12*e* which engages with the engaging recessed portion 6*b* provided on a lower portion of the side surface of the wristwatch case 1 is provided projecting toward the wristwatch case 1, as with the case-side end face 11*a* of the main body piece 11, as shown in FIG. 3 and FIG. 5. The engaging projecting section 12*e* of the first ornament piece 12 is structured to be arranged on the coupling section 11*d* of the main body piece 11 and, in this state, engage with the engaging recessed portion 6*b* of the wristwatch case 1.

As in the case of the first ornament pieces 12, the second ornament piece 13 is made of made of metal such as titanium (Ti) or stainless steel (SUS) and is structured to be arranged between the first ornament pieces 12 arranged in the attachment section 11*c* of the main body piece 11, as shown in FIG. 4 and FIG. 5. In this embodiment the second ornament piece 13 is formed to have a substantially same shape as that of each first ornament piece 12 and to be slightly smaller than the first ornament piece 12.

Figure 6B:
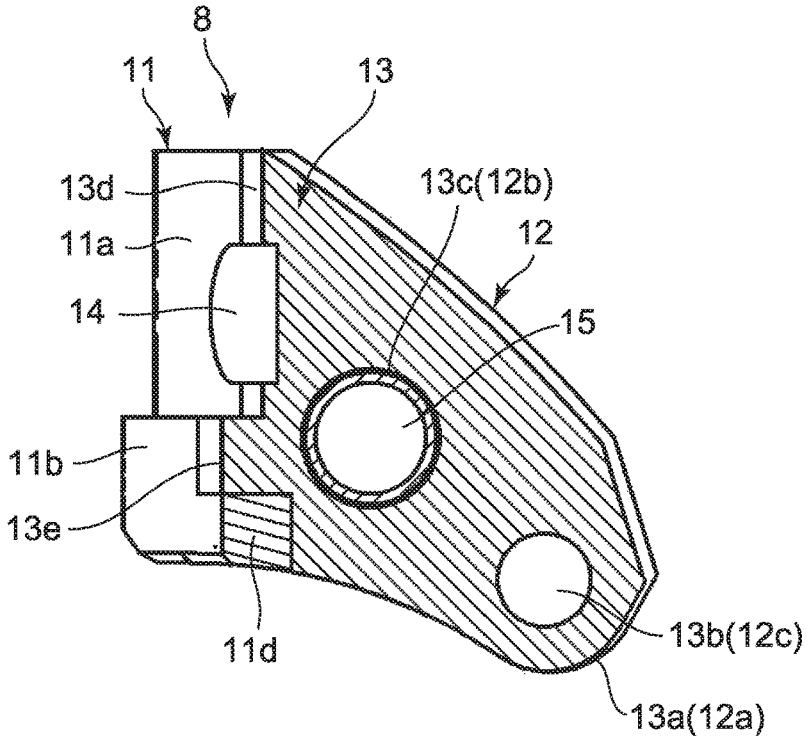
FIG. 6B is an enlarged sectional view of the main portion of the band coupling member of FIG. 3 taken along line B-B of FIG. 4.
Figure 7:
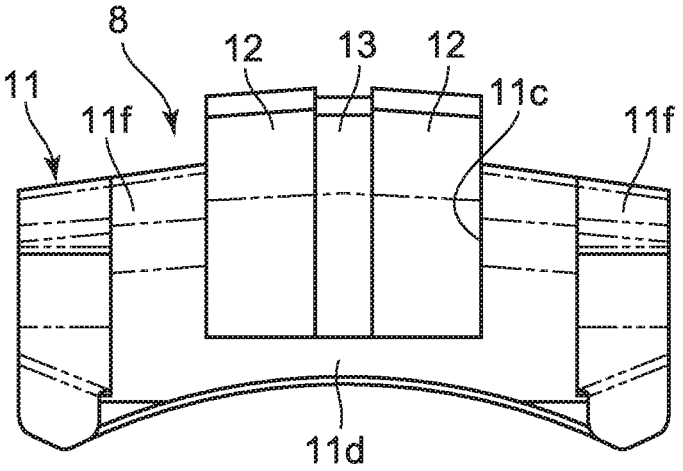
FIG. 7 is an enlarged bottom view of the band coupling member shown in FIG. 3.

That is, as in the case of the first ornament piece 12, the second ornament piece 13 is structured such that a band-side end portion 13*a* on the band main body 7 side projects diagonally downward from the band-side end portion 11*e* of the main body piece 11 with the lower end portion of the second ornament piece 13 corresponding to the lower end portion of the main body piece 11, as with the band-side end portion 12*a* of the first ornament piece 12, as shown in FIG. 4 and FIG. 6B.

Also, the second ornament piece 13 is structured such that a band attachment hole 13*b* into which the second pin member 10 is inserted is provided in the projecting band-side end portion 13*a* as shown in FIG. 8, as with the band attachment hole 12*c* of the first ornament piece 12. In this embodiment, the band attachment hole 13*h* of the second ornament piece 13 is provided corresponding to the band attachment hole 12*c* of the first ornament piece 12 on the same axis.

As a result, the second ornament piece 13 is structured such that the band-side end portion 13*a* projects from a tip end portion of the pair of attachment projecting sections 6*a* in the band attachment section 6 of the wristwatch case 1 toward the band main body 7 side and the end portion 7*a* of the band main body 7 is attached to this projecting band-side end portion 13*a* with the second pin member 10 of FIG. 8, as shown in FIG. 1, FIG. 2, FIG. 4, and FIG. 6A.

In this embodiment, in the second ornament piece 13 as well, a case attachment hole 13*c* into which the first pin member 9 is inserted is provided corresponding to the case attachment hole 12*b* of each first ornament piece 12 on the same axis, as shown in FIG. 8. Also, the upper end of the second ornament piece 13 is formed corresponding to the upper end of the main body piece 11 so as to be at the same height and is slightly lower than the upper end portion of each first ornament piece 12, as shown in FIG. 2, FIG. 4, and FIG. 6A.

Also, in the second ornament piece 13, the case-side end face 13*d* on the wristwatch case 1 side is formed into a shape corresponding to the outer side surface of the wristwatch case 1 as shown in FIG. 4, as with the case-side end face 11*a* of the main body piece 11 and the case-side end face 12*d* of the first ornament piece 12. That is, the case-side end face 13*d* of the second ornament piece 12 is formed having a recessed curved surface, which has the same shape as that of the protruding curved surface of the outer side surface of the wristwatch case 1.

In this case as well, on a lower portion of the case-side end face 13*d* of the second ornament piece 13, an engaging projecting section 13*e* which engages with the engaging recessed section 6*b* provided in a lower portion of the side surface of the wristwatch case 1 is provided projecting toward the wristwatch case 1 as shown in FIG. 3, FIG. 5, and FIG. 6B, as in the case of the case-side end face 11*a* of the main body piece 11. The engaging projecting section 13*e* of the second ornament piece 13 is structured to be arranged on the coupling section 11*d* of the main body piece 11 and, in this state, engage with the engaging recessed portion 6*b* of the wristwatch case 1.

In the band coupling member 8, a fixing recessed portion 14 is provided in the case-side end faces 11*a*, 12*d*, and 13*d* of both side portions 11*f* of the main body piece 11, the first ornament pieces 12, and the second ornament piece 13 opposing the outer side surface of the wristwatch case 1, along the arrangement direction of both side portions 11*f* of the main body piece 11, the first ornament pieces 12, and the second ornament piece 13, as shown in FIG. 3 and FIG. 5.

The fixing recessed section 14 is to cause both side portions 11*f* of the main body piece 11, the first ornament pieces 12, and the second ornament piece 13 to be fixed to one another by welding such as laser welding or by bonding with a bonding agent, and is provided across both side portions 11*f* of the main body piece 11, the first ornament pieces 12, and the second ornament piece 13, as shown in FIG. 3 and FIG. 5.

Each surface of both side portions 11*f* of the main body piece 11, the first ornament pieces 12, and the second ornament piece 13 is subjected to surface treatments with different patterns by surface finishing, as shown in FIG. 4. For example, each surface of both side portions 11*f* of the main body piece 11 and the second ornament pieces 13 is subjected to a surface treatment with a satin-finish pattern. The surface of each first ornament piece 12 is subjected to a surface treatment with a hairline pattern. As a result, each surface of both side portions 11*f* of the main body piece 11, the first ornament pieces 12, and the second ornament piece 13 is formed in a different pattern.

Furthermore, in the band coupling member 8, the case attachment holes 11*g* of the main body piece 11, the case attachment hole 12*b* of the first ornament pieces 12, and the case attachment hole 13*c* of the second ornament piece 13 correspond to one another on the same axis, whereby an auxiliary pipe 15 is fitted into these case attachment holes 11*g*, 12*b*, and 13*c*, as shown in FIG. 8. The auxiliary pipe 15 is to cause both side portions 11*f* of the main body piece 11, the first ornament pieces 12, and the second ornament piece 13 to be pressed and fixed to one another, and is structured to have the first pin member 9 attached inside.

Figure 9:
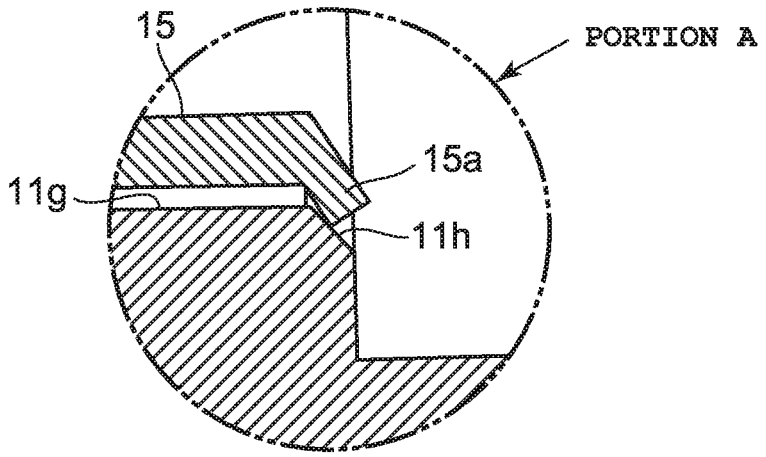
FIG. 9 is an enlarged sectional view of portion A of the band coupling member shown in FIG. 8.

In this embodiment, in the case attachment holes 11*g* provided in both side portions 11*f* of the main body piece 11, each outer side is a large-diameter open hole that is open to a lower side, and each inner side is a circular small-diameter hole, as shown in FIG. 8. Also, at a step portion between the large-diameter open hole and the circular small-diameter hole, a chamfered portion 11*h* is provided, as shown in FIG. 9. Accordingly, the case attachment holes 12*b* of the first ornament pieces 12 and the case attachment hole 13*c* of the second ornament piece 13 are formed having a size equal to the small-diameter hole of each case attachment hole 11*g* of the main body piece 11.

Therefore, the outer diameter of the auxiliary pipe 15 is formed having a size substantially equal to the inner diameter of the small-diameter hole of each of the case attachment holes 11*g* provided in both side portions 11*f* of the main body piece 11, the case attachment hole 12*b* of each first ornament piece 12, and the case attachment hole 13*c* of the second ornament piece 13, as shown in FIG. 8. Also, the length of the auxiliary pipe 15 in the axial direction is formed to be substantially equal to the length between the small-diameter holes of the case attachment holes 11*g* in both side portions 11*f* of the main body pieces 11.

As a result the auxiliary pipe 15 is structured to be swaged in a direction in which both end portions are spread, with it being arranged between the small-diameter holes of the case attachment holes 11*g* in both side portions 11*f* of the main body piece 11, as shown in FIG. 8 and FIG. 9. As a result, the auxiliary pipe 15 is structured such that its swaged portion 15*a* is pressed to the chamfered portion 11*h* at the step portion between the large-diameter open hole and the circular small-diameter hole of the case attachment hole 11*g* so as to press both side portions 11*f* of the main body piece 11, the first ornament pieces 12, and the second ornament piece 13 such that they are fixed to one another.

In this embodiment the first pin member 9 is a spring rod whose both end portions are elastically retractable, as shown in FIG. 8. That is, the first pin member 9 includes a pipe section 9*a*, a spring member 9*b* arranged in the pipe section 9*a*, and a pair of pin sections 9*c* provided at both end portions of the pipe section 9*a* and pressed by the spring member 9*b* so as to be retractable.

The pipe section 9*a* of the first pin member 9 is formed such that its outer diameter is substantially equal to the inner diameter of the auxiliary pipe 15 and its length in the axial direction is substantially equal to the length of the auxiliary pipe 15 in the axial direction. Also, the pair of pin sections 9*c* is structured to project outward from both sides of the band coupling member 8 when pressed from both ends of the pipe section 9 by the spring force of the spring member 9*b*.

As a result, the first pin member 9 is structured such that the pipe section 9*a* is inserted into the auxiliary pipe 15 fitted into each of the case attachment holes 11*g*, 12*b*, and 13*c* of the band coupling member 8 and whereby the first pin member 9 is attached to the band coupling member 8 with the pair of pin sections 9*c* projecting outward from both sides of the band coupling member 8, as shown in FIG. 6.

Also, the first pin member 9 is structured such that, when the pair of pin sections 9*c* are pressed against the spring force of the spring member 9*b* and the band coupling member 8 is arranged between the pair of attachment projecting sections 6*a* of the band attachment section 6 of the wristwatch case 1, the pair of pin sections 9*c* are pressed outward by the spring force of the spring member 9*b* and inserted into attachment holes (not shown) of the pair of attachment projecting sections 6*a*, whereby the band coupling member 8 is attached to the band attachment section 6 of the wristwatch case 1, as shown in FIG. 1 and FIG. 8.

On the other hand, the band coupling member 8 is structured such that the band attachment hole 12*c* provided in the band-side end portions 12*a* of the first ornament pieces 12 projecting from the band-side end portion 11*e* of the main body piece 11 to the band main body 7 side and the corresponding band attachment hole 13*b* provided in the band-side end portion 13*a* of the second ornament piece 13 correspond to each other on the same axis, thereby allowing the insertion of the second pin member 10, as shown in FIG. 8.

In this embodiment, in the band attachment hole 13*b* of the second ornament piece 13, one side (left side in FIG. 8) is formed as a small-diameter hole and the other side (right side in FIG. 8) is formed as a large-diameter hole with a center portion in the axial direction as a boundary, as shown in FIG. 8. Accordingly, of the two first ornament pieces 12, the band attachment hole 12*c* of the first ornament piece 12 on one side (left side in FIG. 8) is formed as a small-diameter hole, and the band attachment hole 12*c* of the first ornament piece 12 on the other side (right side in FIG. 8) is formed as a large-diameter hole.

Also, the second pin member 10 includes a first pin 10*a* provided with a female screw 10*b* and a second pin 100 provided with a male screw 10*d* that is screwed into the female screw 10*b* of the first pin 10*a*, as shown in FIG. 8. In this embodiment, the first pin 10*a* is formed such that its outer diameter is substantially equal to the inner diameter of a large-diameter hole in the band attachment hole 12*c* of the first ornament piece 12 and its length in the axial direction is substantially half of the length of the band main body 7 in the direction orthogonal to the longitudinal direction.

Also, the second pin 10*c* is formed such that its outer diameter is substantially equal to the inner diameter of the small-diameter hole of the band attachment hole 12*c* of the first ornament piece 12 and its length in the axial direction is substantially equal to the length of the first pin 10*a* in the axial direction, that is, substantially half of the length of the band main body 7 in the direction orthogonal to the longitudinal direction, as shown in FIG. 8.

As a result the second pin member 10 is structured such that the first pin 10*a* is inserted from the large-diameter hole of the band attachment hole 12*c* of the first ornament piece 12 into the large-diameter hole of the band attachment hole 13*b* of the second ornament piece 13 and the second pin 10*c* is inserted from the small-diameter hole of the band attachment hole 12*c* of the first ornament piece 12 into the small-diameter hole of the band attachment hole 13*b* of the second ornament piece 13, as shown in FIG. 8.

In this embodiment, the end portion 7*a* of the band main body 7 is provided with a recessed portion 7*b* in which the band-side end portions 12*a* and 13 of the first and second ornament pieces 12 and 13 are each inserted, as shown in FIG. 1 and FIG. 8. Also, in each of the sides of the recessed portion 7*b* at the end portion 7*a* of the band main body 7, an attachment hole 7*c* corresponding to the band attachment holes 12*c* and 13*b* of the first and second ornament pieces 12 and 13 are provided in the direction orthogonal to the longitudinal direction of the band main body 7.

As a result, the second pin member 10 is structured such that the first pin 10*a* is inserted into the large-diameter holes of the band attachment holes 12*c* and 13*b* of the first and second ornament pieces 12 and 13 through one attachment hole 7*c* of the band main body 7, with the attachment holes 7*c* of the end portion 7*a* of the band main body 7 corresponding to the band attachment holes 12*c* and 13*b* of the first and second ornament pieces 12 and 13, as shown in FIG. 1 and FIG. 8.

Also, the second pin member 10 is structured such that the second pin 10*c* is inserted into the small-diameter holes of the band attachment holes 12*c* and 13*b* of the first and second ornament pieces 12 and 13 through the other attachment hole 70 of the hand main body 7 and, in this state, the end portion 7*a* of the band main body 7 is attached to the band-side end portions 12*a* and 13*a* of the first and second ornament pieces 12 and 13 when the male screw 10*d* is screwed into the female screw 10*b*, as shown in FIG. 1 and FIG. 8.

Next, the mechanism of the band 5 for a wristwatch is described.

First, in the manufacture of the band coupling member 8, one main body piece 11, two first ornament pieces 12, and one second ornament piece 13 are separately manufactured in advance, and their surfaces are each subjected to a surface treatment. Here, the surfaces of the main body piece 11 and the second ornament piece 13 are each subjected to a surface treatment with a satin-finish pattern, and the surfaces of the two second ornament pieces 12 are each subjected to a surface treatment with a hairline pattern, as shown in FIG. 4.

Then, the first ornament pieces 12 and the second ornament piece 13 are mounted on the main body piece 11. In this embodiment, the first ornament pieces 12 are arranged on both sides in the attachment section 11*c* between both side portions 11*f* of the main body piece 11, and the second ornament piece 13 is arranged between these first ornament pieces 12. As a result, both side portions 11*f* of the main body piece 11, the first ornament pieces 12, and the second ornament piece 13 are arranged and mounted in the direction orthogonal to the longitudinal direction of the band main body 7, as shown in FIG. 3 and FIG. 5.

Here, the case attachment holes 11*g* provided in both side portions 11*f* of the main body piece 11, the case attachment holes 12*b* of the first ornament pieces 12, and the case attachment hole 13*c* of the second ornament piece 13 correspond to one another on the same axis, as shown in FIG. 8. Also, the band attachment holes 12*c* of the first ornament pieces 12 and the band attachment hole 13*b* of the second ornament piece 13 correspond to one another on the same axis.

In this state, the case-side end faces 11*a* of both side portions 11*f* of the main body piece 11, the case-side end faces 12*d* of the first ornament pieces 12, and the case-side end face 13*d* of the second ornament piece 13 are arranged having a recessed curved surface, which has the same shape as that of the protruding curved surface of the outer side surface of the wristwatch case 1. Here, the engaging projecting sections 11*b* of both side portions 11*f* of the main body piece 11, the engaging projecting sections 12*e* of the first ornament pieces 12, and the engaging projection section 13*e* of the second ornament piece 13 are arranged on the same plane.

In addition, the fixing recessed portion 14 is provided in the case-side end faces 11*a* of both side portions 11*f* of the main body piece 11, the case-side end faces 12*d* of the first ornament pieces 12, and the case-side end face 13*d* of the second ornament piece 13 across both side portions 11*f* of the main body piece 11, the first ornament pieces 12, and the second ornament piece 13 along the arrangement direction. Furthermore, the band-side end faces 12*a* of the first ornament pieces 12 and the band-side end face 13*a* of the second ornament piece 13 significantly project from the band-side end portion 11*e* of the main body piece 11.

In this embodiment, the band-side end faces 12*a* and 13*a* are exposed at a position of projecting from the band-side end portions 11*e* of the main body piece 11, with the band attachment holes 12*c* of the first ornament pieces 12 projecting from the band-side end portion 11*e* of the main body piece 11 corresponding to the band attachment hole 13*b* of the second ornament piece 13. Also, here, an upper end portion of each first ornament piece 12 projects slightly upward from an upper end portion of the main body piece 11 and an upper end portion of the second main ornament piece 13.

Then, both side portions 11*f* of the main body piece 11, the first ornament pieces 12, and the second ornament piece 13 arranged in the direction orthogonal to the longitudinal direction of the band main body 7 are fixed to one another by welding such as laser welding or by bonding with a bonding agent. Here, in the fixing recessed portion 14 provided across the main body piece 11, the first ornament pieces 12, and the second ornament piece 13, both side portions 11*f* of the main body piece 11, the first ornament pieces 12, and the second ornament piece 13 are fixed to one another by welding such as laser welding or by bonding with a bonding agent.

In addition, the auxiliary pipe 15 is fitted into the small-diameter hole of each of the case attachment holes 11*g* provided in both side portions 11*f* of the main body piece 11, the case attachment holes 12*b* of the first ornament pieces 12, and the case attachment hole 13*c* of the second ornament piece 12. In this state, both end portions of the auxiliary pipes 15 are swaged to be spread.

Then, the swaged portions 15*a* at both end portions of the auxiliary pipe 15 are each pressed to the chamfered portion 11*h* provided at the step portion between the large-diameter open hole and the circular small-diameter hole of the case attachment hole. 11*g*. Accordingly, both side portions 11*f* of the main body piece 11, the first ornament pieces 12, and the second ornament piece 13 are pressed and fixed to one another by both end portions of the auxiliary pipe 15 being swaged. As a result, the band coupling member 8 is manufactured.

Next, the attachment of the band main body 7 to the band attachment section 6 of the wristwatch case 1 via the band coupling member 8 is described.

First, in the attachment of the band coupling member 8 to the end portion 7*a* of the band main body 7, the band-side end portions 12*a* and 13*a* of the first and second ornament pieces 12 and 13 in the band coupling member 8 are inserted into the recessed portion 7*b* provided to the end portion 7*a* of the band main body 7 such that the band attachment holes 12*c* and 13*b* of the first and second ornament pieces 12 and 13 correspond to the attachment holes 7*c* of the end portion 7*a* of the band main body 7.

In this state, the first pin 10*a* of the second pin member 10 is inserted from one attachment hole 7*c* of the band main body 7 into the large-diameter holes of the band attachment holes 12*c* and 13*b* of the first and second ornament pieces 12 and 13. Also, the second pin 10*c* of the second pin member 10 is inserted from the other attachment hole 7*c* of the band main body 7 into the small-diameter holes of the band attachment holes 12*c* and 13*b* of the first and second ornament pieces 12 and 13.

In this state, the male screw 10*d* of the second pin 10*c* is screwed into the female screw 10*b* of the first pin 10*a* and fastened, whereby the end portion 7*a* of the band main body 7 is attached to the band-side end portions 12*a* of the first ornament pieces 12 and the band-side end portion 13*a* of the second ornament piece 13.

Also, in the attachment of the band coupling member 8 to the band attachment section 6 of the wristwatch case 1, the first pin member 9 is attached by being inserted into the auxiliary pipe 15 fitted into the small-diameter holes of the case attachment holes 11*g* provided in both side portions 11*f* of the main body piece 11, the case attachment holes 12*b* of the first ornament pieces 12, and the case attachment hole 13*c* of the second ornament piece 13 in the band coupling member 8.

Here, the pipe section 9*a* of the first pin member 9 is inserted into the auxiliary pipe 15 fitted into the case attachment holes 11*g*, 12*b*, and 13*c* of the band coupling member 8 such that the pair of pin sections 9*c* project outward from both sides of the band coupling member 8. In this state, the pair of pin sections 9*c* of the first pin member 9 are pressed against the spring force of the spring member 9*b* so that the band coupling member 8 is arranged between the pair of attachment projecting sections 6*a* in the band attachment section 6 of the wristwatch case 1.

Then, the pair of pin sections 9*c* are pressed outward by the spring force of the spring member 9*b* and inserted into the attachment holes (not shown) provided opposing each other in the pair of projecting sections 6*a*. As a result, the band coupling member 8 is attached to the band attachment section 6 of the wristwatch case 1.

As such, this band 5 for a wristwatch includes the band main body 7, and the band coupling member 8 that is attached to the end portion 7*a* of the band main body 7 and the band attachment section 6 of the wristwatch case 1 corresponding thereto. The band coupling member 8 is structured to have the plurality of component pieces 11 to 13 arranged in the direction orthogonal to the longitudinal direction of the band main body 7 and fixed to one another. Therefore, only a minimum number of components are required, excellent ornamental quality can be achieved, and attachment work can be simplified.

That is, in the band 5 for a wristwatch, the plurality of component pieces 11 to 13 can be mutually fixed and integrated with them being arranged, so that the ornamental quality of the band coupling member 8 can be enhanced. In addition, even though the band coupling member 8 is constituted by the plurality of component pieces 11 to 13, the band coupling member 8 can be attached as one component. As a result of this structure, only a minimum number of components are required, excellent ornamental quality can be achieved, and attachment work can be simplified.

In this embodiment, the plurality of component pieces 11 to 13 include the main body piece 11 where the attachment section 11*c* is provided and the first ornament pieces 12 and the second ornament piece 13 arranged and mounted on the attachment section 11*c* of the main body piece 11. Accordingly, by the main body piece 11, the first ornament pieces 12, and the second ornament piece 13, the ornamental quality of the band coupling member 8 can be enhanced, whereby the design quality and the outer appearance quality can be enhanced.

In this embodiment, in the band coupling member 8, the surfaces of the main body piece 11, the first ornament pieces 12, and the second ornament piece 13 can be subjected to surface treatments with different patterns by surface processing. Accordingly, the ornamental quality of the band coupling member 8 can be further enhanced, and whereby the design quality and the outer appearance quality can be further enhanced.

That is, in the band coupling member 8, for example, the surfaces of the main body piece 11 and the second ornament piece 13 can be each subjected to a surface treatment with a satin-finish pattern, and the surface of each first ornament pieces 12 can be subjected to a surface treatment with a hairline pattern. Thus, the band coupling member 8 with extremely high ornamental quality can be provided.

Also, in the band coupling member 8, the case-side end faces 11*a*, 12*d*, and 13*d*, which are the surfaces of the main body piece 11, the first ornament pieces 12, and the second ornament piece 13 opposing the wristwatch case 1, are each formed into a shape corresponding to an outer surface of the wristwatch case 1 in the band attachment section 6. Accordingly, the case-side end faces 11*a*, 12*d*, and 13*d* of the main body piece 11, the first ornament pieces 12, and the second ornament piece 13 can be brought into close contact with the outer surface of the wristwatch case 1.

That is, in the band coupling member 8, when the band coupling member 8 is arranged to the band attachment section 6 of the wristwatch case 1, the case-side end faces 11*a*, 12*d*, and 13*d* of the main body piece 11, the first ornament pieces 12, and the second ornament piece 13 are brought into close contact with the outer surface of the wristwatch case 1 in the band attachment section 6 without a gap. By this structure as well, the design quality and the outer appearance quality can be enhanced.

Also, in the case-side end faces 11*a*, 12*d*, and 13*d* which are the surfaces of the main body piece 11, the first ornament pieces 12, and the second ornament piece 13 of the band coupling member 8 opposing the wristwatch case 1, the fixing recessed portion 14 for causing the main body piece 11, the first ornament pieces 12, and the second ornament piece 13 to be fixed to one another by welding or bonding is provided across the main body piece 11, the first ornament pieces 12, and the second ornament piece 13 in the arrangement direction. Accordingly, in the fixing recessed portion 14, both side portions 11*f* of the main body piece 11, the first ornament pieces 12, and the second ornament piece 13 can be fixed by welding such as laser welding or by bonding with a bonding agent.

That is, in the band coupling member 8, both side portions 11*f* of the main body piece 11, the first ornament pieces 12, and the second ornament piece 13 can be reliably and strongly fixed by welding such as laser welding or by bonding with a bonding agent. In addition, burrs in welding and an overflow of a bonding agent can be contained within the fixing recessed portion 14. Moreover, the fixing recessed portion 14 can be hidden by the outer surface of the wristwatch case 1. By this structure as well, the design quality and the outer appearance quality can be enhanced.

Also, the band coupling member 8 includes the auxiliary pipe 15 for fixing the main body piece 11, the first ornament pieces 12, and the second ornament piece 13 in the arrangement direction, whereby the auxiliary pipe 15 can be fitted into the small-diameter holes of the case attachment holes 11*g* provided in both side portions 11*f* of the main body piece 11, the case attachment holes 12*b* of the first ornament pieces 12, and the case attachment hole 13*c* of the second ornament piece 12, and both side portions 11*f* of the main body piece 11, the first ornament pieces 12, and the second ornament piece 13 can be fixed and pressed to one another.

That is, by both end portions of the auxiliary pipe 15 being swaged to spread with the auxiliary pipe 15 being fitted into the small-diameter holes of the case attachment holes provided in both side portions 11*f* of the main body piece 11, the case attachment holes 12*b* of the first ornament pieces 12, and the case attachment hole 13*c* of the second ornament piece 13, the swaged portion 15*a* can be pressed to the chamfered portion 11*h* at the step portion between the large-diameter hole and the small-diameter hole, and both side portions 11*f* of the main body piece 11, the first ornament pieces 12, and the second ornament piece 13 can be pressed to one another and fixed together.

Moreover, in the band coupling member 8, the first pin member 9 is inserted into the auxiliary pipe 15 fitted into the small-diameter holes of the case attachment holes provided in both side portions 11*f* of the main body piece 11, the case attachment holes 12*h* of the first ornament pieces 12, and the case attachment hole 13*c* of the second ornament piece 13, and this first pin member 9 causes the band coupling member 8 to be attached to the band attachment section 6 of the wristwatch case 1, so that the band coupling member 8 can be reliably and strongly attached to the band attachment section 6 of the wristwatch case 1.

In this embodiment, the first pin member 9 is a spring rod with both end portions elastically retractable, and includes the pipe section 9*a*, the spring member 9*b* that is arranged inside the pipe section 9*a*, and the pair of pin sections 9*c* that is provided at both end portions of the pipe section 9*a* and pressed by the spring member 9*b* so as to be retractable. With this first pin member 9, the band coupling member 8 can be easily and reliably attached to the band attachment section 6 of the wristwatch case 1.

That is, the first pin member 9 causes the pipe section 9*a* to be inserted into the auxiliary pipe 15 in the band coupling member 8 so as to press the pair of pin sections 9*c* against the spring force of the spring member 9*b*. In this state, when the band coupling member 8 is arranged between the pair of attachment projecting sections 6*a* in the band attachment section 6 of the wristwatch case 1, the pair of pin sections 9*c* are pressed outward by the spring force of the spring member 9*b* and inserted into attachment holes (not shown) of the pair of attachment projecting sections 6*a*. Accordingly, the band coupling member 8 can be easily and reliably attached to the band attachment section 6 of the wristwatch case 1.

Also, in the band coupling member 8, the first ornament pieces 12 and the second ornament piece 13 project to the band main body 7 side from the band attachment section 6 of the wristwatch case 1, and the attachment holes 12*c* and 13*b* are provided in the band-side end portions 12*a* and 13*a* of the projecting first ornament pieces 12 and second ornament piece 13. By being attached to the end portion 7*a* of the band main body 7 with the second pin member 10 inserted into these attachment holes 12*c* and 13*b*, the band coupling member 8 can be reliably and strongly attached to the band main body 7.

In this embodiment, the second pin member 10 includes the first pin 10*a* provided with the female screw 10*b* and the second pin 10*c* provided with the male screw 10*d* that is screwed into the female screw 10*b* of the first pin 10*a*. Accordingly, only by the male screw 10*d* of the second pin 10*c* being screwed into the female screw 10*b* of the first pin 10*a*, the band coupling member 8 can be easily and reliably attached to the band main body 7.

That is, in the second pin member 10, the first pin 10*a* is inserted into the band attachment holes 12*c* and 13*b* from one attachment hole 7*c* of the band main body 7 with the band attachment holes 12*c* and 13*b* of the first and second ornament pieces 12 and 13 corresponding to the attachment holes 7*c* of the end portion 7*a* of the band main body 7, the second pin 100 is inserted into the band attachment holes 12*c* and 13*b* from the other attachment hole 7*c* of the band main body 7, and the male screw 10*d* is screwed into the female screw 10*b*. Accordingly, the band coupling member 8 can be easily and reliably attached to the end portion 7*a* of the band main body 7.

In the above-described embodiment, the surfaces of the main body piece 11 and the second ornament piece 13 are each subjected to a surface treatment with a satin-finish pattern, and the surfaces of the first ornament pieces 12 are each subjected to a surface treatment with a hairline pattern. However, the present invention is not limited thereto. For example, the surfaces of the main body piece 11 and the second ornament piece 13 may be each subjected to a surface treatment with a hairline pattern, and the surfaces of the first ornament pieces 12 may be each subjected to a surface treatment with a satin-finish pattern. Also, all of the surfaces of the main body piece 11, the first ornament pieces 12, and the second ornament piece 13 may be subjected to a surface treatment with the same pattern.

Also, in the above-described embodiment, the two first ornament pieces 12 and the one second ornament piece 13 are arranged on the attachment section 11*c* of the main body piece 11. However, the present invention is not limited thereto. For example, one or three or more first ornament pieces 12 may be arranged, two or more second ornament pieces 13 may be arranged, or an arbitrary number of first ornament pieces 12 and second ornament pieces 13 may be arranged.

Moreover, in the above-described embodiment, a spring rod is used as the first pin member 9. However, the present invention is not limited thereto. A pin member constituted by a first pin member with a female screw and a second pin member with a male screw or a pin member having retaining members provided at both end portions of a pin may be used.

Furthermore, in the above-described embodiment, the second pin member 10 is constituted by the first pin member 10*a* with the female screw 10*b* and the second pin member 10*c* with the male screw 10*d*. However, the present invention is not limited thereto. A pin member such as a spring rod or a pin member having retaining members provided at both end portions of a pin may be used.

Still further, in the above-described embodiment, the present invention has been applied in a wristwatch. However, the present invention is not necessarily required to be applied in a wristwatch, and can be widely applied in a band for an arm-wearable device, a bag, a purse, or the like.

While the present invention has been described with reference to the preferred embodiments, it is intended that the invention be not limited by any of the details of the description therein but includes all the embodiments which fall within the scope of the appended claims.

What is claimed is:

1. A band comprising:

a band main body; and a band coupling member which is attached to an end portion of the band main body and which is configured to be attached to a band attachment section of an attachment target member corresponding to the end portion of the band main body, wherein the band coupling member comprises a plurality of component pieces which are arranged in a direction orthogonal to a longitudinal direction of the band main body and fixed to one another, and wherein the plurality of component pieces include:

a main body piece including a coupling section configured to be positioned at an outer side surface of the attachment target member, and an attachment section where an upper side is open, and a plurality of ornament pieces arranged and mounted on the attachment section of the main body piece.

2. The band according to claim 1, wherein each of surfaces of the main body piece and the plurality of ornament pieces of the band coupling member configured to oppose the attachment target member has a shape corresponding to an outer surface of the attachment target member in the band attachment section.

3. The band according to claim 2, wherein each of the surfaces of the band coupling member configured to oppose the attachment target member has a fixing recessed section which is provided across the main body piece and the plurality of ornament pieces in an arrangement direction thereof, for fixing the main body piece and the plurality of ornament pieces to one another by welding or bonding.

4. The band according to claim 1, wherein the band coupling member includes an auxiliary pipe for fixing the plurality of component pieces in an arrangement direction thereof.

5. The band according to claim 2, wherein the band coupling member includes an auxiliary pipe for fixing the plurality of component pieces in an arrangement direction thereof.

6. The band according to claim 3, wherein the band coupling member includes an auxiliary pipe for fixing the plurality of component pieces in the arrangement direction thereof.

7. The band according to claim 4, wherein the band coupling member is attachable to the band attachment section of the attachment target member by a pin member inserted into the auxiliary pipe.

8. The band according to claim 5, wherein the band coupling member is attachable to the band attachment section of the attachment target member by a pin member inserted into the auxiliary pipe.

9. The band according to claim 6, wherein the band coupling member is attachable to the band attachment section of the attachment target member by a pin member inserted into the auxiliary pipe.

10. The band according to claim 1, wherein the plurality of ornament pieces of the band coupling member project toward the band main body more than the main body piece of the band coupling member, and a projecting band-side end of each of the plurality of ornament pieces is attached to the end portion of the band main body by a pin member.

11. The band according to claim 2, wherein the plurality of ornament pieces of the band coupling member project toward the band main body more than the main body piece of the band coupling member, and a projecting band-side end of each of the plurality of ornament pieces is attached to the end portion of the band main body by a pin member.

12. The band according to claim 3, wherein the plurality of ornament pieces of the band coupling member project toward the band main body more than the main body piece of the band coupling member, and a projecting band-side end of each of the plurality of ornament pieces is attached to the end portion of the band main body by a pin member.

13. The band according to claim 4, wherein the plurality of ornament pieces of the band coupling member project toward the band main body more than the main body piece of the band coupling member, and a projecting band-side end of each of the plurality of ornament pieces is attached to the end portion of the band main body by a pin member.

14. A timepiece comprising the band according to claim 1.

15. A timepiece comprising the band according to claim 2.

16. A timepiece comprising the band according to claim 3.

17. The band according to claim 1, wherein the main body piece of the band coupling member comprises two side portions which hare coupled by the coupling section, wherein the attachment section is positioned between the two side portions in the direction orthogonal to the longitudinal direction of the band main body, and wherein the two side portions of the main body piece sandwich the plurality of ornament pieces in the direction orthogonal to the longitudinal direction of the band main body.

18. The band according to claim 1, wherein the attachment section comprises a notch positioned between the two side portions in the direction orthogonal to the longitudinal direction of the band main body.

19. A band comprising:

a band main body; and a band coupling member which is attached to an end portion of the band main body and which is configured to be attached to a band attachment section of an attachment target member corresponding to the end portion of the band main body, wherein the band coupling member comprises a plurality of component pieces which are arranged in a direction orthogonal to a longitudinal direction of the band main body and fixed to one another, wherein each of surfaces of the band coupling member configured to oppose the attachment target member has a fixing recessed section which is provided across the plurality of component pieces in an arrangement direction thereof, for fixing the plurality of component pieces to one another by welding or bonding, and wherein the fixing recessed section is not exposed from an outer surface of the attachment target member when the band coupling member is attached to the band attachment section of the attachment target member.

* * * * *